US007152989B2

(12) United States Patent
Radley-Smith

(10) Patent No.: US 7,152,989 B2
(45) **Date of Patent: *Dec. 26, 2006**

(54) BRACELET

(76) Inventor: Philip J. Radley-Smith, 6 Newcroft Cottages, Selsfield Road, Ardingly, West Sussex PH17 6TJ (GB)

( * ) Notice: Subject to any disclaimer, the term of this patent is extended or adjusted under 35 U.S.C. 154(b) by 184 days.

This patent is subject to a terminal disclaimer.

(21) Appl. No.: 10/294,762

(22) Filed: Nov. 15, 2002

(65) Prior Publication Data

US 2003/0066308 A1 Apr. 10, 2003

Related U.S. Application Data

(63) Continuation of application No. 09/801,772, filed on Mar. 9, 2001, now Pat. No. 6,571,577, which is a continuation of application No. 08/875,721, filed on Jul. 11, 1997, now Pat. No. 6,216,490, which is a continuation of application No. PCT/GB96/00069, filed on Jan. 15, 1996.

(30) Foreign Application Priority Data

Jan. 13, 1995 (GB) ..... 9500668.0
Feb. 7, 1995 (GB) ..... 9502348.7

(51) Int. Cl.
*F21V 21/104* (2006.01)

(52) U.S. Cl. ..... 362/104; 368/282; 345/903; 345/949; 63/3; 63/33

(58) Field of Classification Search ..... 63/1.11, 63/1.13, 3; 368/41, 223, 281, 282, 226, 241, 368/242, 82; 345/56; 40/450, 451, 452; 362/104

See application file for complete search history.

(56) References Cited

U.S. PATENT DOCUMENTS

| | | | | |
|---|---|---|---|---|
| 1,346,493 A | | 7/1920 | Hammond et al. | 340/815.47 |
| 2,322,461 A | | 6/1943 | Mariano | 63/3 |
| 3,604,707 A | * | 9/1971 | Hurley | 463/49 |
| 3,976,995 A | * | 8/1976 | Sebestyen | |
| 4,117,542 A | | 9/1978 | Klausner et al. | 345/169 |
| 4,130,987 A | | 12/1978 | Schickendanz | 368/282 |
| 4,141,074 A | | 2/1979 | Popper | 364/705 |
| 4,205,312 A | * | 5/1980 | Nelson | |
| 4,365,245 A | | 12/1982 | Colmenero | 340/792 |
| 4,365,246 A | | 12/1982 | Dewolf et al. | 340/802 |
| 4,472,066 A | | 9/1984 | Murakami | 368/82 |

(Continued)

FOREIGN PATENT DOCUMENTS

DE 3508365 12/1985

(Continued)

OTHER PUBLICATIONS

Christopher Lloyd, Time Comes for the Superwatch, "The Times", Jan. 1995 (before Jan. 13, 1995).

(Continued)

*Primary Examiner*—Jack W. Lavinder
(74) *Attorney, Agent, or Firm*—Nixon & Vanderhye P.C.

(57) ABSTRACT

A bracelet includes at least one electronic display unit. Each display unit has a display having a plurality of display elements arranged in a sequence lying along the length of the bracelet and/or arranged in a sequence lying substantially around the perimeter of the display. The bracelet has a control circuit to control the display elements so that the characters displayed by the display elements appear to move along the sequence of display elements with time. In the alternative, the characters appear to move along a discrete face which is provided along the bracelet.

40 Claims, 12 Drawing Sheets

U.S. PATENT DOCUMENTS

| | | | | |
|---|---|---|---|---|
| 4,601,584 | A | 7/1986 | DeWolf et al. | |
| 4,847,818 | A | 7/1989 | Olsen | 368/10 |
| 4,993,004 | A | 2/1991 | Loizeaux | |
| 5,125,078 | A | 6/1992 | Matsuda et al. | 345/56 |
| 5,214,623 | A | 5/1993 | Seager | 368/10 |
| 5,214,624 | A | 5/1993 | Siebrasse | |
| 5,251,189 | A | 10/1993 | Thorp | 368/4 |
| 5,260,915 | A | 11/1993 | Houlihan | 368/282 |
| 5,410,520 | A * | 4/1995 | Stampfer | 368/240 |
| 5,416,730 | A | 5/1995 | Lookofsky | 364/708.1 |
| 5,418,760 | A | 5/1995 | Kawashima et al. | |
| 5,537,407 | A * | 7/1996 | Park et al. | 370/314 |
| 5,746,501 | A | 5/1998 | Chien | |
| 6,216,490 | B1 | 4/2001 | Radley-Smith | 63/3 |
| 6,442,107 | B1 * | 8/2002 | Takagi | 368/226 |
| 6,571,577 | B1 * | 6/2003 | Radley-Smith | 63/3 |

FOREIGN PATENT DOCUMENTS

| | | |
|---|---|---|
| DE | 3810527 | 10/1989 |
| DE | 3813409 | 11/1989 |
| DE | 29912001 | 1/2000 |
| EP | 0 408 086 | 1/1991 |
| FR | 2 360 114 | 2/1978 |
| FR | 2 599 867 | 12/1987 |
| FR | 2599867 | 12/1987 |
| FR | 2660096 | 9/1991 |
| GB | 2136673 | 9/1984 |
| GB | 2218895 | 11/1989 |
| JP | 62-245184 | 10/1987 |
| WO | WO 90/10897 | 9/1990 |
| WO | WO 94/04967 | 3/1994 |
| WO | WO96/21888 | 7/1996 |

OTHER PUBLICATIONS

"Timex Data Link", Watch Brochure, Timex Corporation. Description of the original Timex Data Link (Model 70) Watch (taken from the www.timex.com website.

* cited by examiner

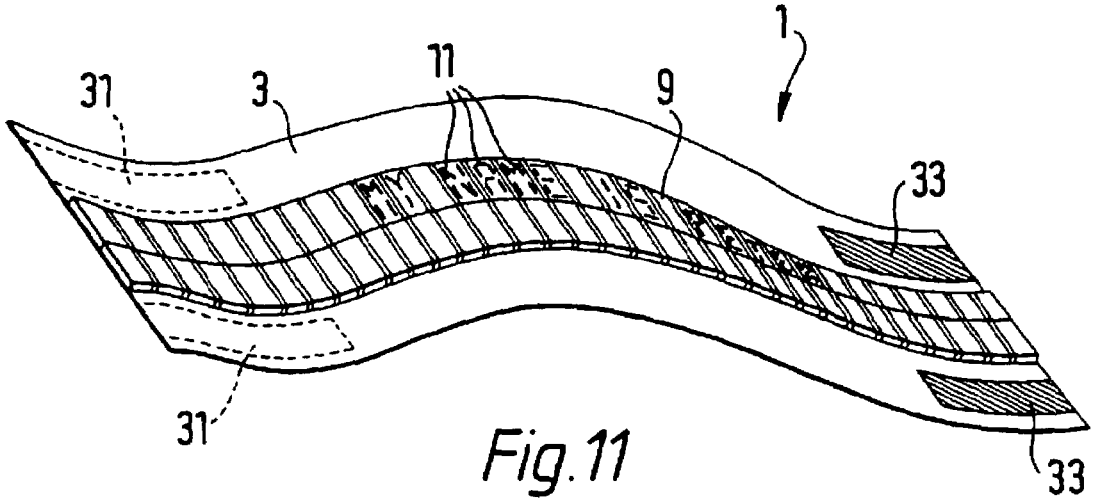
Fig.11
Fig.12a
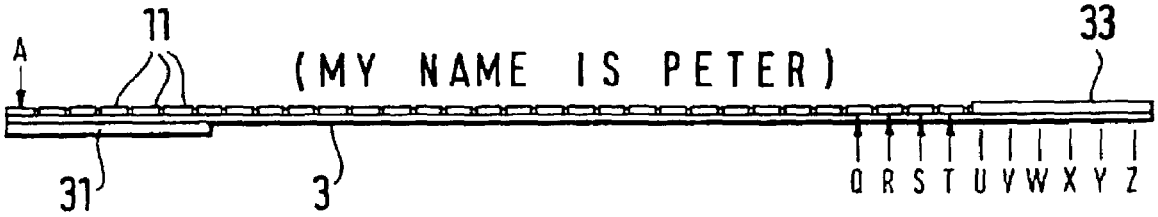
Fig.12b
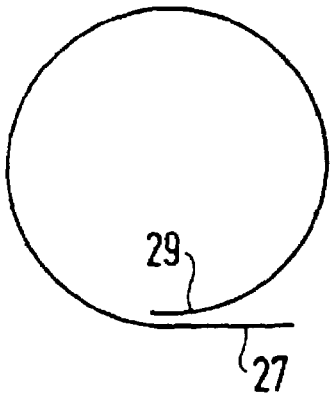
Fig.12c
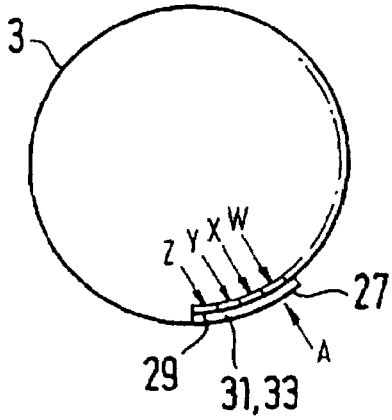

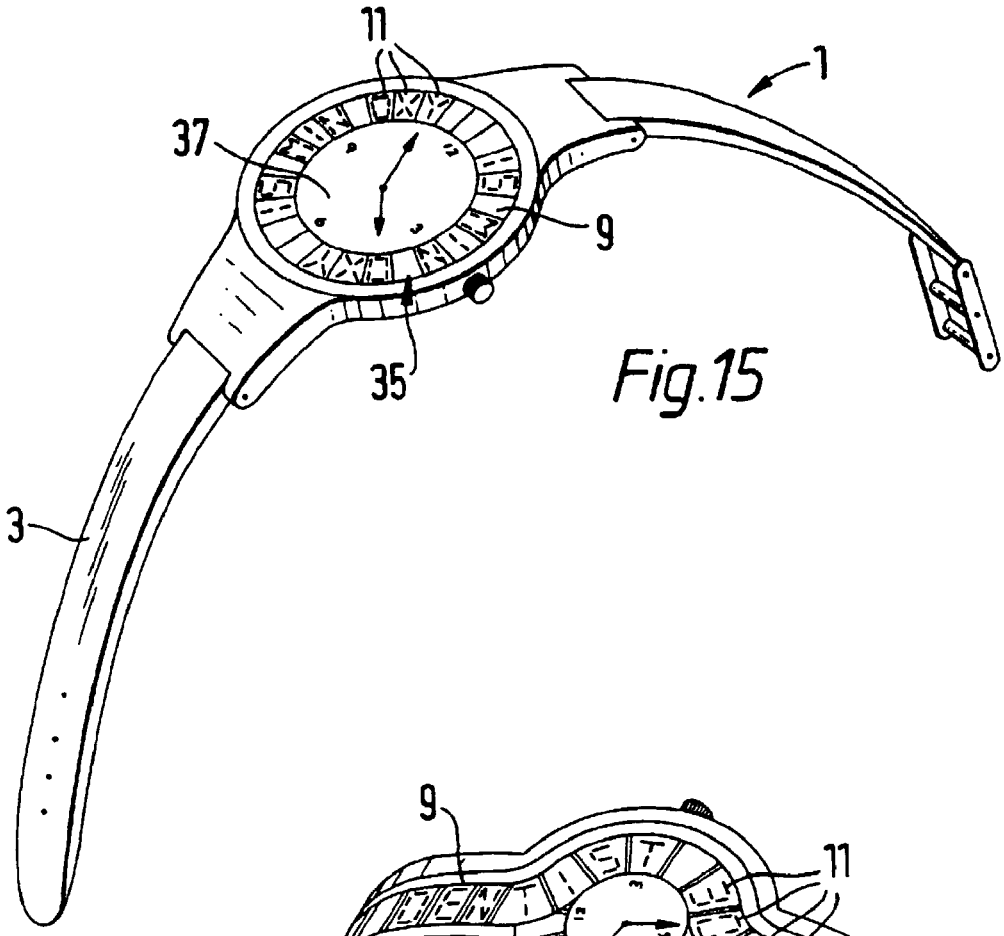
Fig.15
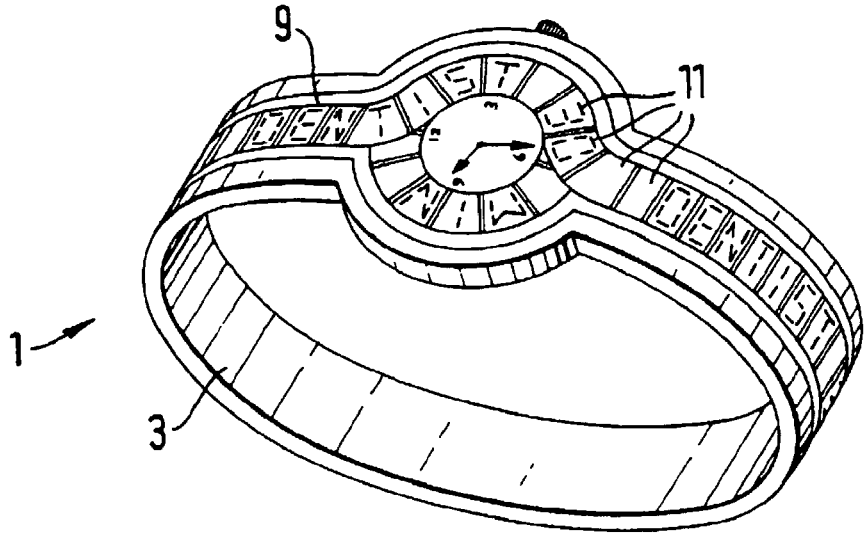
Fig.16
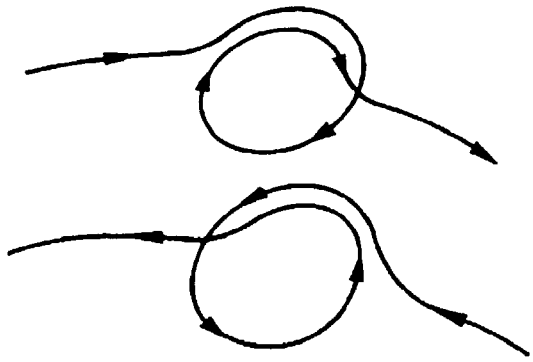

5
5
5

BRACELET

This application is a continuation of U.S. application Ser. No. 09/801,772, filed Mar. 9, 2001, now U.S. Pat. No. 6,571,577. which is a continuation of U.S. application Ser. No. 08/875,721, filed Jul. 11, 1997, now U.S. Pat. No. 6,216,490, which is a continuation of PCT/GB96/00069, filed Jan. 15, 1996, which, in turn, claims priority from United Kingdom application no. 9500668.0, filed Jan. 13, 1995 and United Kingdom application No. 9502348.7, filed Feb. 7, 1995, the contents of each of which are incorporated herein by reference.

BACKGROUND OF THE INVENTION

The present invention relates to a bracelet.

The term, "bracelet", when used in this specification, is not limited to a wrist bracelet but is intended to include bracelets such as ring or belt bracelets which may be worn on other parts of the body, such as the ankle, a finger or even around the waist. Furthermore, such bracelets need not be solely for human use but could be worn by animals, e.g. as collars, or, if desired, attached to inanimate objects.

DESCRIPTION OF PRIOR ART

A known bracelet which displays information is a digital watch, having a watch face with a liquid crystal display. Typically, the watch face has at least four conventional seven-segment numerical display elements so that the time can be displayed digitally using the standard 24 hour clock notation.

The watch will usually have additional functions such as an alarm, a stop-watch, etc, and so a solid state chip/integrated circuit is included to implement these functions together with a quartz crystal to keep time and a battery for powering the watch.

In DE-A-3 813 409 (Osterhage) there is disclosed a wrist watch with a multi-digital display, consisting of a continuous chain of individual bracelet links, each bracelet link being constructed as a digital display, controlled by a piezoelectric control circuit which provides a multi-digit display which is pulsed from bracelet link to bracelet link so that the digital display pulses in time around the bracelet.

SUMMARY OF THE INVENTION

The present invention provides a bracelet having an electronic display unit including a display region comprising a plurality of display elements, each display element capable of displaying a character of one or more characters so that the display elements together can display said characters, in the display region; the display elements being arranged in a sequence lying along the length of the bracelet and/or in a sequence lying substantially around at least part of the perimeter of the display region; wherein control means is provided to control the display elements so that the characters displayed by the display elements in the display region appear to move along the sequence of display elements with time.

In one embodiment, the bracelet has a single display unit extending along a portion of the length of the bracelet.

Preferably, the single unit has a plurality of display elements each comprising a lattice of liquid crystal or LED segments. The liquid crystal or LED segments may be selectively energised to display one of a plurality of different characters. Preferably, the liquid crystal or LED segments are arranged and may be selectively energised, to display numerical and/or alphabetical characters.

However, it will be appreciated that abstract characters and shapes could be formed by the display elements to give the appearance of a moving pattern.

The control means may be a solid state chip/integrated circuit which can control the display elements to display information in the form of characters. The solid state chip may control the display elements so that the characters displayed appear to move along the sequence of display elements in the display region, element by element, with time.

The display region can be divided into a plurality of sub-regions each comprising a plurality of display elements forming a portion of the sequence of display elements. It is then possible for the display elements to display information simultaneously within each sub-region and the control means may control the display elements such that the information displayed in each sub-region appears to move, preferably element by element, from a first end of said respective portion of said sequence of display elements to a second end of said respective portion of said sequence of display elements with time.

In another embodiment, the bracelet comprises a plurality of electronic display units each having a predetermined number of display elements. The display elements of the display units together form a display region, each display element being capable of displaying a character of one or more characters so that the display elements together can display information, in the form of said characters, in the display region. The display units are arranged so that collectively their display elements form a sequence lying along the length of the bracelet. The display units are preferably arranged in groups of at least three adjacent units, each group forming a sub-region of said display region so that the display elements can display information simultaneously within each sub-region. Control means is provided to control the display elements to display characters such that the characters are displayed in each group of display units, firstly, in the first unit of the group of display units, secondly in the second unit of the group of display units and thirdly in a third unit of the group of display units so that the characters appear to move, within the sub-region of said display region, with time.

Further preferred and advantageous features of the present invention will be apparent from the following description and accompanying claims.

BRIEF DESCRIPTION OF THE DRAWINGS

Embodiments of the present invention will now be described by way of example, with reference to the accompanying drawings, in which:

FIG. 11 is a perspective view of a bracelet forming a fourth embodiment of the present invention;

FIGS. 12*a, b* and *c* are side views of the bracelet of FIG. 11 lying flat, in an intermediate position, before being fastened and in a final position fastened for use, respectively;

FIG. 15 is a perspective view of a bracelet forming a seventh embodiment of the present invention;

FIG. 16 is a perspective view of a bracelet forming an eighth embodiment of the present invention;

DETAILED DESCRIPTION OF PREFERRED EMBODIMENTS

Figure 1:
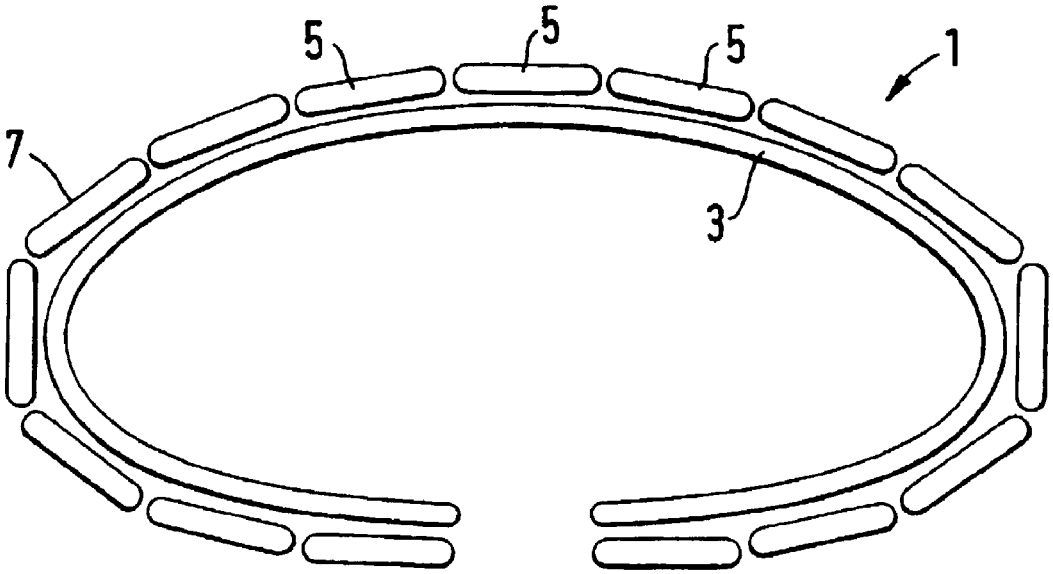
FIG. 1 is a side view of a bracelet forming a first embodiment of the present invention.
Figure 2:
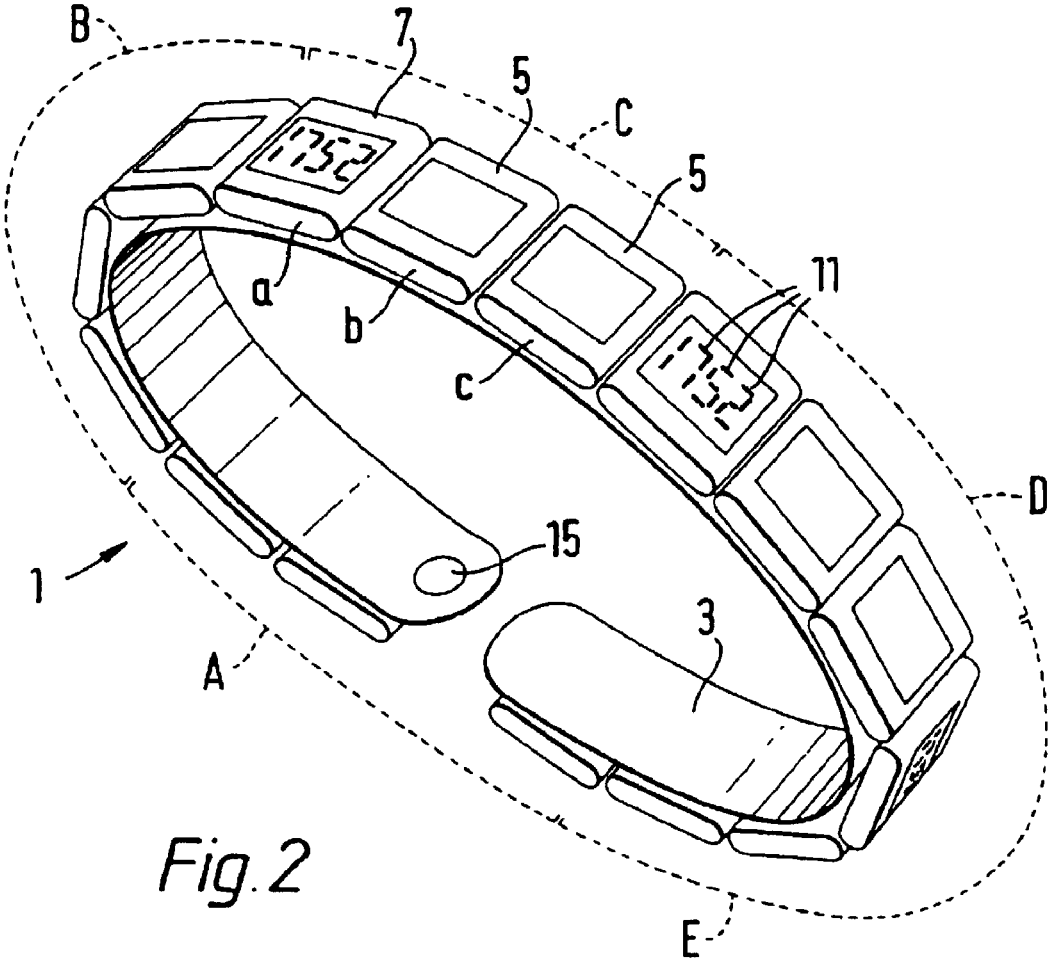
FIG. 2 is a perspective view of the bracelet of FIG. 1.

FIGS. 1 and 2 shows a bracelet 1 forming a first embodiment of the present invention. The bracelet 1 comprises a strap 3 carrying a plurality of digital electronic display units 5. It will be understood, however, that the display units could be made integral with the strap.

The display units 5 can conveniently be of any conventional type used for watches, calculators, or the like. In this way, the bracelet can be manufactured cheaply by using "off-the-shelf" parts. In the illustrated embodiment, conventional watch units are used. Such units 5 are individually housed in cases 7 and each has a compartment for a battery to provide power to the unit, a quartz crystal for time keeping, and control chip/integrated circuit to control the display unit. (It will be appreciated that all units 5 could be powered by a single battery, and a single quartz crystal and/or control chip could be employed for all the units.) Each unit 5 has a liquid crystal display (LCD) 9 comprising a sequence of four display elements 11 (the sequence being arranged to lie, in a line, along the length of the bracelet) which are controlled by the control chip.

In this embodiment, the liquid crystal display 9 of each unit 5 has only four display elements 11, but it will be appreciated that the LCD could include more than four display elements.

The display elements 11 of the display units 5 together form a display region of the bracelet.

Each display element 11 has a conventional arrangement of seven liquid crystal segments which can be selectively energised to display any single numerical character from 0 to 9. Thus, the units can be used to display numerical information up to four figures, such as the time in 24 hour clock notation.

The units 5 are arranged in groups (labelled A, B, C, D, E) of 3 units, each group forming a sub-region of the display region. The units 5 can, if required, each be individually set to the correct time. However, in the illustrated embodiment, the bracelet 1 is provided with an integrated circuit 15 which controls all units so that each unit can be programmed with the same time simultaneously. It will be appreciated that each group of units 5 could be programmed independently of the other groups, so that different times could be displayed by each group, for example, to show the time in different time zones.

Each sub-region of the display region displays characters simultaneously with the other sub-regions. Thus, characters are displayed at regular intervals along the bracelet and so viewing is possible from a number of different angles.

Each group (A, B, C, D, E) of units comprises three display units a, b and c. Each of the three display units 5 has an integrated circuit/chip or other control circuit which switches the LCD display 9 on and off intermittently and, in particular, the LCD display 9 is switched on for a period of one second every three seconds in time.

Integrated circuit 15 synchronises the three units 5 in the groups so that only one unit 5 in a group (A, B, C, D, E) is displaying at any one time. The units 5 are synchronised so that the left-hand unit a of the three displays information, the time in numerical characters, say, for a first second, the middle unit, b, displays the time for the next second and the right-hand unit c, displays the time in the following (i.e. third) second. This cycle of displaying the time successively on each unit, is then repeated so that in a fourth second the left-hand unit, a, displays the time again and so on.

It will be appreciated that if the individual display units 5 were independently programmed with the time, they could also be independently programmed to switch their LCD displays on and off to synchronise the display of the time as set out above so that synchronising integrated circuit 15 would not be necessary.

The result is that, in use, the switching on and off of the display units gives the appearance of a continuous movement of the information (i.e. the time) within the sub-region along the length of the bracelet.

It will be appreciated that the direction of movement of the information could be reversed to travel from right to left.

It will be appreciated that more than three units can be used in each group so that the information displayed will be spaced further apart. It will also be appreciated that the speed and duration of switching the LCD of each unit on and off can be varied to change the look and manner of the movement of information along the bracelet.

However, the use of three units in each group has the advantage that the time is displayed frequently on the face of any one unit which is being viewed so that the need for the wearer to turn his wrist to see the time displayed is eliminated.

Figure 3:
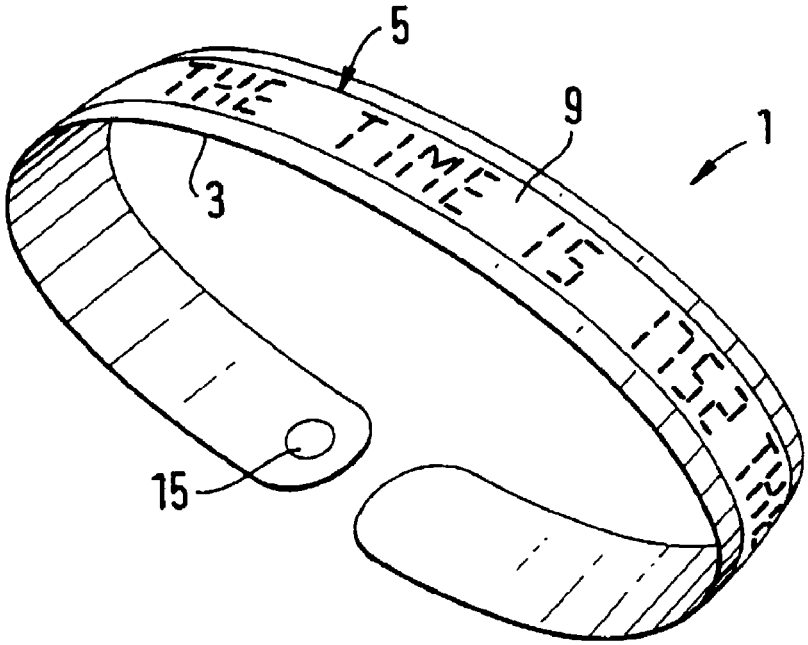
FIG. 3 is a perspective view of a bracelet forming a second embodiment of the present invention.

FIG. 3 shows a second embodiment of the present invention. Features corresponding to those described in the first embodiment are given like reference numerals. In this embodiment the bracelet 1 has a single display unit 5 incorporating an LCD 9 extending along substantially the full length of the bracelet. The display unit 5 is, in this embodiment integral with the strap 3.

Figure 4A:
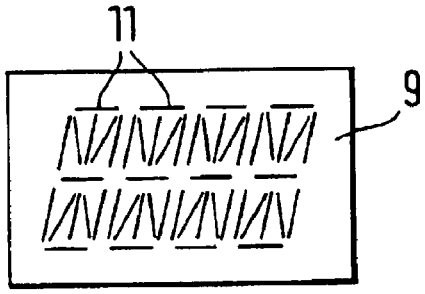
FIG. 4*a* is an enlarged plan view of a part of the liquid crystal display of the bracelet of FIG. 3.
Figure 4B:
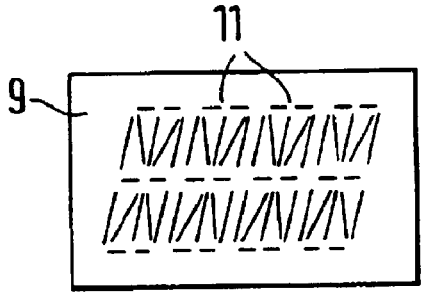
FIG. 4*b* is a plan view of a corresponding part of an alternative liquid crystal display for the bracelet of FIG. 3.

The LCD 9 provides a display region and comprises a large number of adjacent display elements 11 for displaying information in a sequence along the length of the bracelet As shown in FIG. 4*a*, each element is an alphanumeric display element comprising thirteen liquid crystal segments arranged in a lattice so that the segments can be selectively energised to display any numeral from 0 to 9 and any letter from A to Z. Alternatively, each element could comprise a sixteen segment alphanumeric display element as shown in FIG. 4*b* which can similarly display any numeral from 0 to 9 and any letter from A to Z. Thus, the bracelet 1 can be used to display information other than simply the time. The information could be stored as messages and such messages could be pre-programmed into memory and read out and displayed by a controlling integrated circuit/chip 15.

It is envisaged that the bracelet could also or alternatively be programmed by the user by downloading information from an electronic personal organiser or personal computer into the memory of the bracelet. Methods of doing this are known in the art and will not be described herein.

The bracelet might also include a receiver for receiving data, transmitted in the form of electromagnetic radiation such as radio waves, which could be programmed into the memory and subsequently displayed by the bracelet. Thus, the bracelet could be used as a pager or to display the latest travel information or sports results.

The control chip/integrated circuit 15 of the bracelet 1 according to this second embodiment, can be used to energise the display elements 11 of the LCD 9 to display a message, for instance, "THE TIME IS 1752". The chip/integrated circuit 15 can also control the LCD to move the message by changing the energisation of individual display elements with time. In the same way as with the first embodiment, control of the switching of the display elements 11 can give the appearance of a moving message. However, in the second embodiment, it is preferred to move the message on, one element at a time, so that the movement is more fluent. Additionally, the message can be moved along virtually the whole length of LCD, which effectively extends along the whole length of the bracelet 1, instead of being moved within a sub-region of the LCD.

It will be appreciated that a message which is longer than the length of the LCD 9 can be displayed by virtue of the movement of the information across the display, although there will always be a part of the message (at the beginning or the end) which is not visible on the LCD.

It will further be appreciated that the bracelet of the second embodiment of the invention will have a quartz crystal for time-keeping, and may include the usual alarm functions of a watch. Furthermore, an alarm function can be used to trigger a message for the wearer, such as a reminder of an appointment, etc.

This embodiment can be utilised for many purposes. For instance, a bracelet could be used in hospitals to store details of a patient's identity, their relevant medicine, etc. The bracelet could also be used by children to give personal information. Alternatively, the bracelet could be simply used as an item of jewellery.

Figure 5:
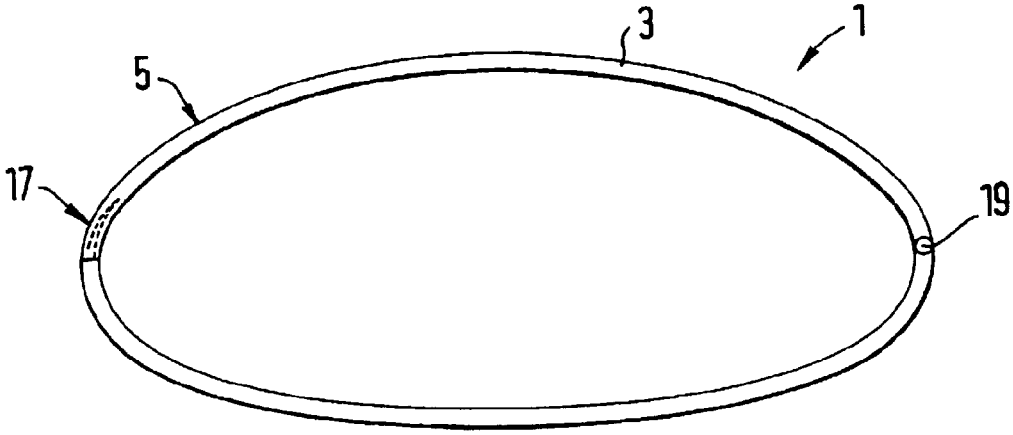
FIG. 5 is a side view of a bracelet forming a third embodiment of the present invention.
Figure 6:
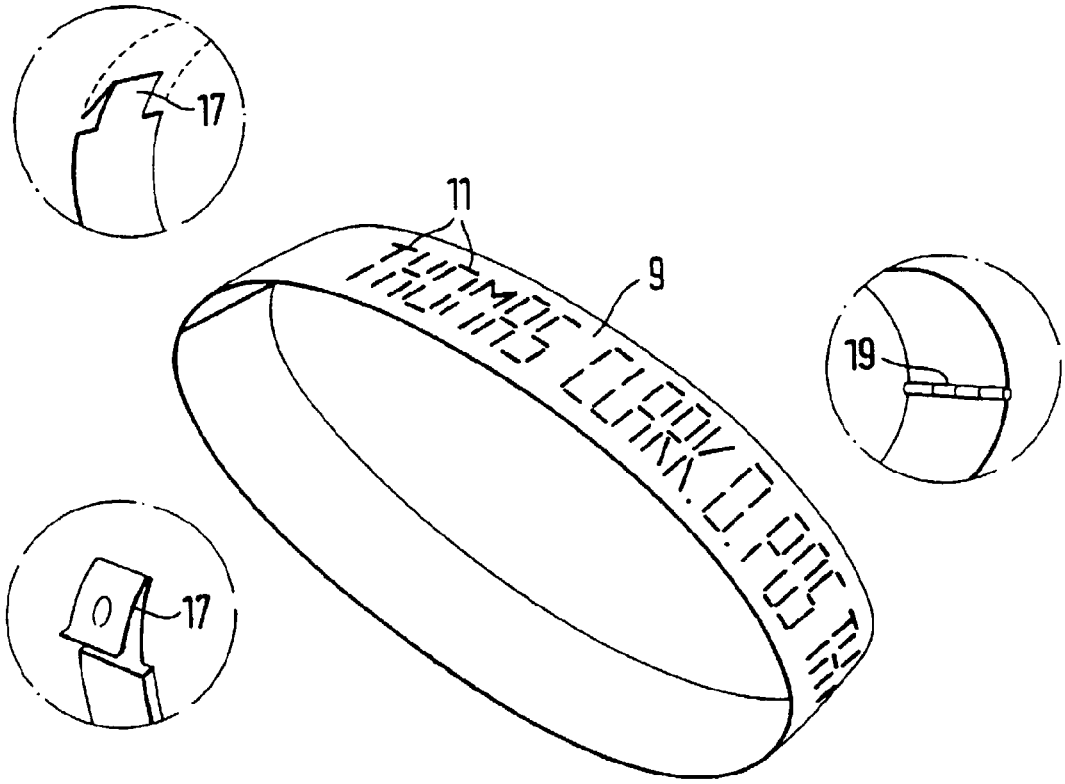
FIG. 6 is a perspective view of the bracelet of FIG. 5.

FIGS. 5 and 6 show a third embodiment of the present invention. In this embodiment, which is similar to the second embodiment, the strap 3 of the bracelet is continuous by virtue of the use of a conventional catch 17 and hinge 19 arrangement. This enables the liquid crystal display 9 to extend around the total length of the bracelet so that a moving message will appear to circulate (or cycle) continuously around the bracelet.

Further features, and the operation, of the third embodiment are the same as that of the second embodiment and so the reader is referred to the description of the second embodiment.

FIGS. 11 and 12 show a fourth embodiment of the present invention. In this embodiment the bracelet 1 has a flexible fabric "wrap-around" strap 3 which carries a display unit 5 incorporating an LCD 9 extending along its length. The LCD 9 forms a display region and has a sequence of adjacent alphanumeric display elements 11 for displaying characters, and is controlled by a control chip (not shown).

The strap 3 has hook 31 and loop 33 Velcro® fastening pads on opposite sides of respective ends to enable the strap to be adjustably fastened around the wrist of a user.

Characters can be displayed and moved along the length of the bracelet under the control of a control chip in the same manner as described in respect of previous embodiments.

Since the strap of the bracelet of this embodiment is a "wrap-around" strap, a portion 27 of one end of the strap will overlap a portion 29 of the other end of the strap. As a consequence of the overlap, some of the display elements 11 at the right hand end of the bracelet may not be visible, the number depending upon the size of wrist of the user. In FIG. 12*b* four display elements (WXYZ) are hidden.

In order to avoid part of the message being obscured by the overlap of the strap, and in order to maintain a continuous movement of the message around the bracelet, the hidden display elements are not utilised. Thus, if the control chip moves a displayed message from left to right, when the right-most letter or numeral of the message reaches the last display element (V) before the hidden elements, it will skip the hidden elements (WXYZ) and restart the message at the first display element (A). In this way continuity of movement of the message is maintained.

In order to achieve this, the user must program into the control chip the identity (location) of those display elements which are overlapped when the bracelet is fastened on his wrist. Alternatively, the bracelet could be fitted with one or more sensors to detect which display elements are overlapped and to automatically program the control chip accordingly.

Figure 13:
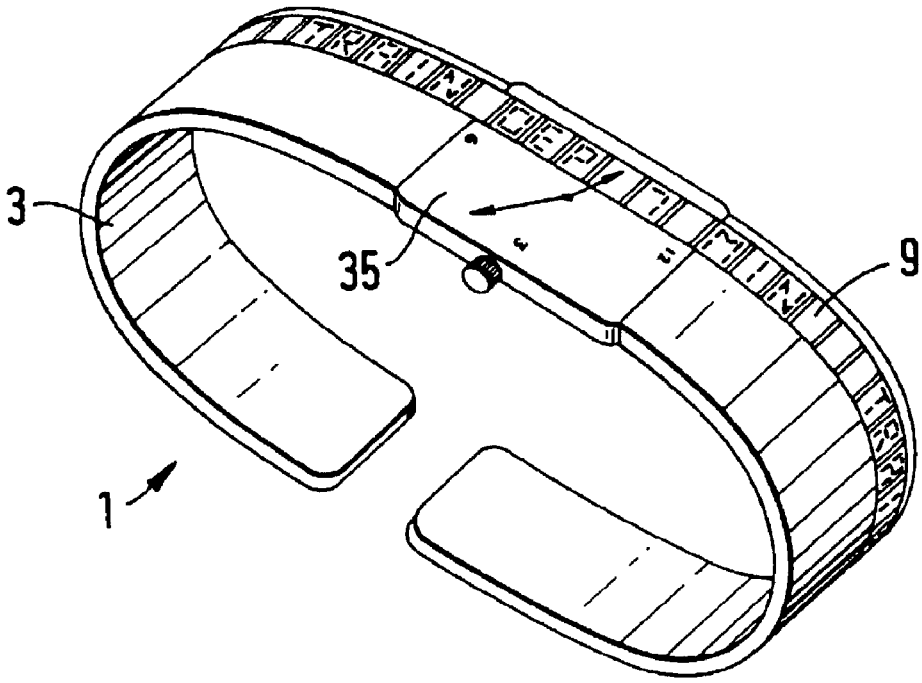
FIG. 13 is a perspective view of a bracelet forming a fifth embodiment of the present invention.

FIG. 13 shows a fifth embodiment of the present invention which is a variation of the second embodiment. In this arrangement the bracelet 1 is a watch bracelet and has a conventional analog watch face 35 and the LCD 9 runs along the length of the bracelet across the watch face 35.

Figure 14:
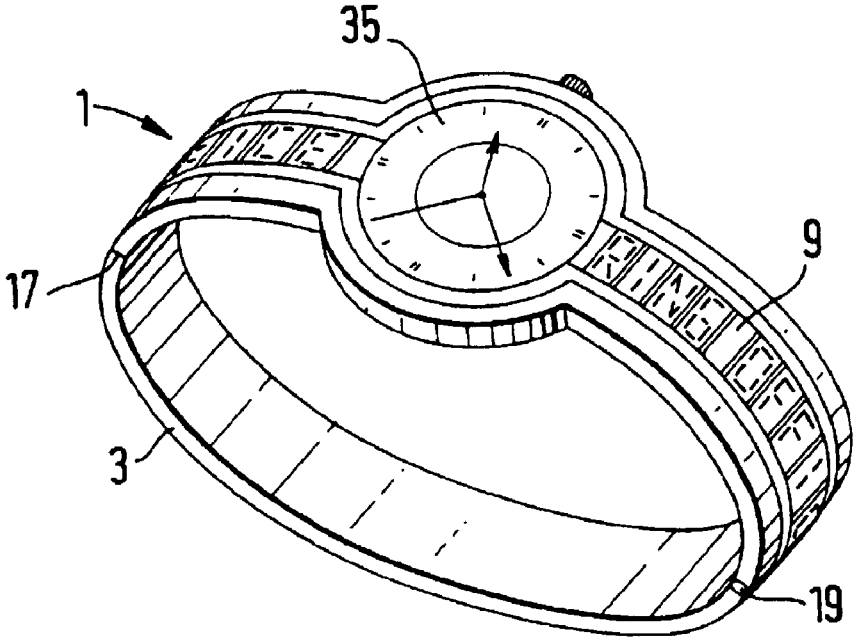
FIG. 14 is a perspective view of a bracelet forming a sixth embodiment of the present invention.

FIG. 14 shows a sixth embodiment of the present invention. This embodiment is similar to that shown in FIG. 13 except that the LCD 9 does not run across the analog display face 35. Accordingly, in this embodiment, a circulating message will be controlled to give the appearance of the message "jumping" from one side of the analog watch face 35 to the other.

FIG. 15 shows a seventh embodiment of the present invention. In this embodiment, the bracelet 1 is a watch having a conventional strap 3. The face 35 of the watch has an analog display 37 at its centre which is surrounded by an LCD 9 extending in a closed loop around the perimeter of the face 35.

The LCD 9 comprises a sequence of alphanumeric display elements 11 which are arranged in a sequence lying around the perimeter of the watch face, so that characters can be displayed around the central analog display 37.

Additionally, the characters displayed on the LCD can be controlled by a control chip (not shown) to give the appearance of movement around the perimeter of the watch face in the same way as a message appears to move along the length of the bracelet in the previously described embodiments. In this way, a message can be displayed which has more characters than the number of display elements on the watch face.

FIGS. 16 and 17 show an eighth embodiment of the present invention. This embodiment utilises a more complex LCD arrangement by combining the features of the sixth embodiment with the features of the seventh embodiment. Thus, the bracelet 1 has a circular face 35 and an LCD 9 comprising (as shown in FIG. 17*a*) a first sequence 9*a* of alphanumeric display elements 11, extending along the length of the bracelet and a second sequence 9*b* of alphanumeric display elements extending in a closed loop around the perimeter of the face. At a first interface 51 between the first sequence 9*a* and the second sequence 9*b* there is an overlap of four display elements (4, 5, 28, 29) as shown in FIG. 17*a*. Similarly at a second interface there is an overlap of a further four display elements (16, 17, 40, 41).

A control chip can accordingly "move" characters, which typically form a message, in a path along the length of the bracelet, then smoothly onto the face 35 utilising the appropriate display elements (4 and 5) at the interface, around the perimeter of the face and then smoothly off the face and along the length of the bracelet again, as shown by the directional arrows illustrated in FIGS. 16 and 17. The direction of movement can be from left to right or right to left along the bracelet and can be clockwise or anticlockwise around the perimeter of the face of the bracelet.

It will be appreciated that just a part of the sequence of display elements around the perimeter of the watch face could be used to display the message. Thus, for instance, the message could be moved along the bracelet from left to right around the top or bottom semicircle of the watch face.

Figure 17A:
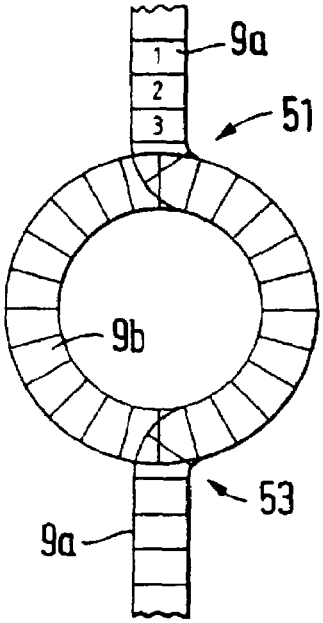
FIGS. 17*a, b, c, d, e* and *f* are plan views of alternative arrangements of display elements for use with the bracelet of FIG. 16.
Figure 17B:
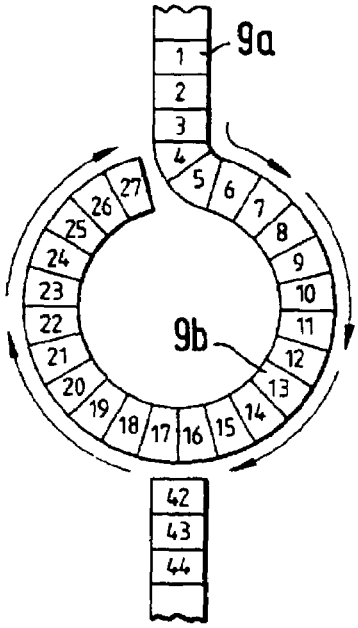
Figure 17C:
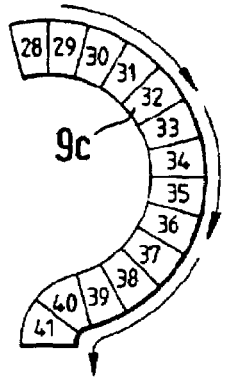
Figure 17D:
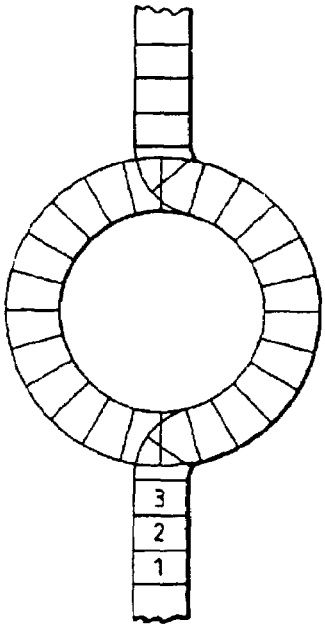
Figure 17E:
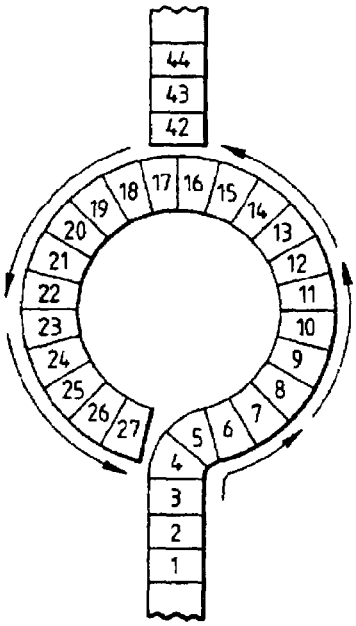
Figure 17F:
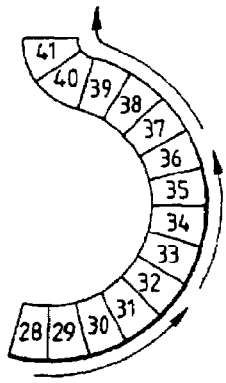

In an alternative arrangement of display element, the second sequence 9*b* of the display elements has the additional sequence of display elements 9*c* shown in FIG. 17*c* which underlie display elements numbered 5 to 16 in FIG. 17*b*. these elements are utilised when the message has completed a circle around the perimeter of the face. This allows a longer message to be displayed because two parts of a message do not "share" the same display elements, as would otherwise be the case, which would result in a conflict in what is displayed on those elements.

It will be appreciated that the watch face need not be circular but could be rectangular or oval. Furthermore, the LCD need not extend around the total perimeter of the face but could form an open loop so that the beginning and end of a message is clearly visible.

Figure 18A:
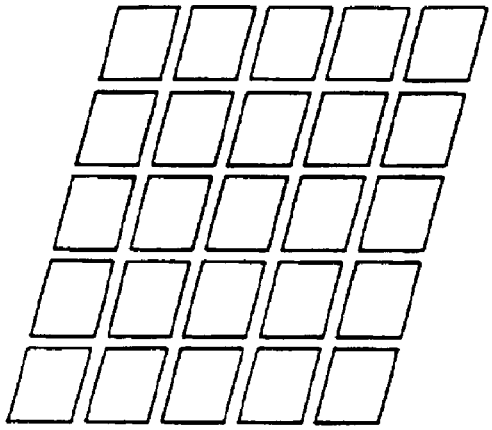
FIGS. 18*a, b* and *c* show plan views of a "dot-matrix" liquid crystal display element displaying different shapes and figures, and FIGS. 19*a, b* and *c* are perspective views of a bracelet forming a ninth embodiment of the present invention, each view showing the display at successive moments in time.
Figure 18B:
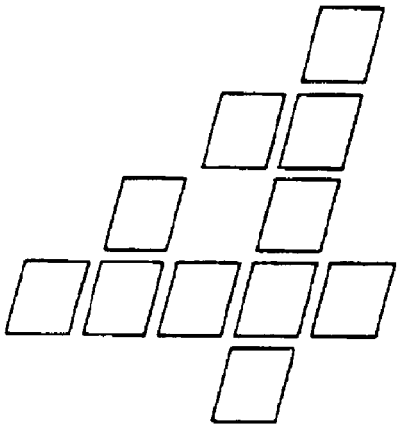
Figure 18C:
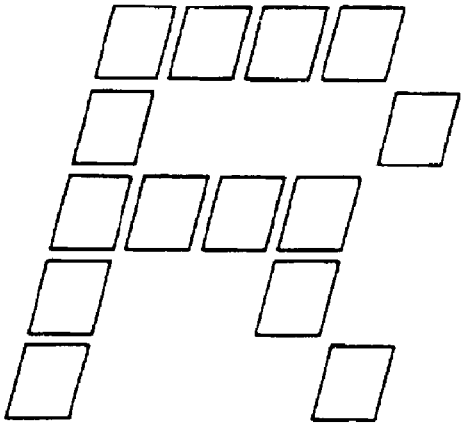

It will be appreciated that various modifications can be made to the described embodiments. For instance, the bracelet could employ suitable displays other than the described segmental LCD display elements, for example segmental LED display elements could be used. Furthermore, the LCD display unit or units can have display elements other than the numeric seven-segment or alphanumeric thirteen or sixteen-segment arrangements. An example is a "dot-matrix" type display element having twenty five liquid crystal cells arranged in a rectangular matrix (see FIG. 18*a* which shows all the cells energised). The cells can be selectively energised to display many different shapes and figures as shown in FIGS. 18*b* and *c*, as well as letters from Greek or Russian alphabets, Chinese characters, etc. In the claims the term "segment" is intended to encompass the "cells" of such a dot-matrix display element.

The display elements could also display shapes or figures such as animals or characters which might move. Examples of these are shown in FIGS. 7 to 10.

In particular, FIG. 7 shows display elements with liquid crystal segments arranged to form the shape of a dinosaur. FIG. 7*a* shows a first position of the dinosaur and FIG. 7*b* shows a second position of the dinosaur. It will be understood that the energising of successive elements alternately in the first and second positions will give the impression of movement of the dinosaur. FIG. 7*c* shows the crystal segments common to the two positions of the dinosaur in FIG. 7*a* and FIG. 7*b*. FIG. 7*d* shows in dotted lines the additional segments required to enable the display element to show the dinosaur in both the first and second positions, and FIG. 7*e* shows all the crystal segments required to form the shape of the dinosaur in both positions.

Figure 9C:
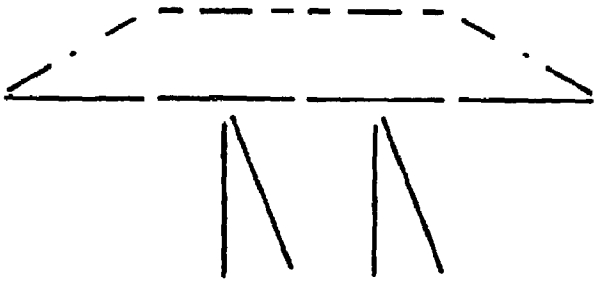
Figure 9B:
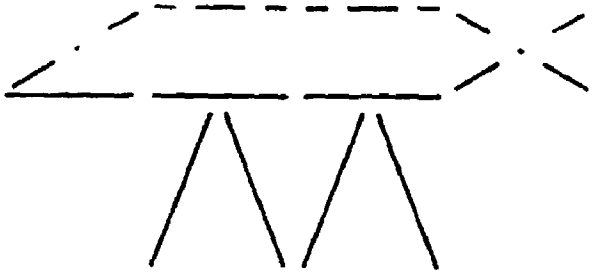
Figure 9A:
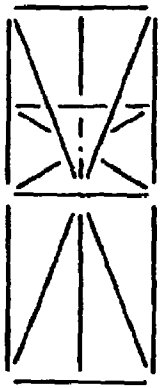
Figure 10C:
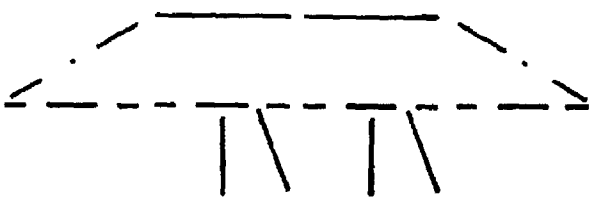
Figure 10B:
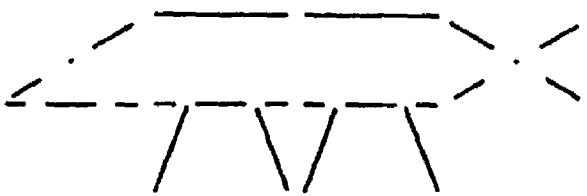
Figure 10A:
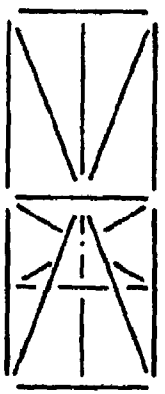

FIGS. 8, 9 and 10 show how moving figures (in this case an ant-like creature) can be formed by using the conventional thirteen-segment alphanumeric crystal arrangement together with an additional LCD lattice arrangement of crystal segments.

The additional lattice can underlie or overlie the thirteen-segment alphanumeric LCD lattice. The number and arrangement of the segments in the additional lattice (shown in FIG. 8*c*) can be varied, and its position relative to the alphanumeric display (shown in FIG. 8*b*) can also be varied to alter the shape of the creature (e.g. to give it short legs rather than long legs).

By using the conventional alphanumeric lattice, a message can be moved along the bracelet and, if the creature is displayed by a display element immediately after the last letter or numeral of the message that is displayed by that display element, the creature can appear to be chasing the message as it moves along the LCD of the bracelet. Similarly, if the creature is displayed immediately before the first letter or numeral of the message, the message will appear to be chasing the creature.

Figure 7A:
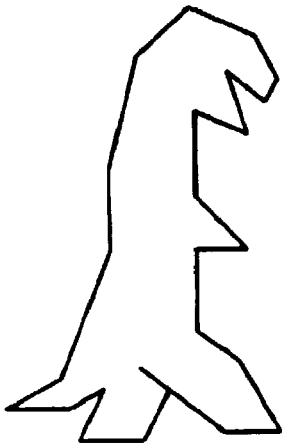
FIGS. 7 to 10 show plan views of various liquid crystal display elements which can be used in a bracelet according to the present invention.
Figure 7B:
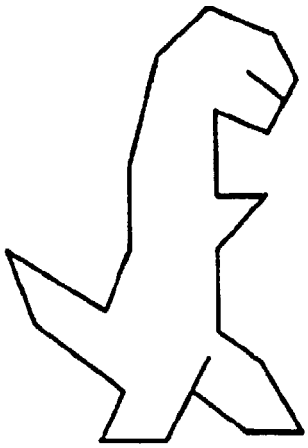
Figure 7C:
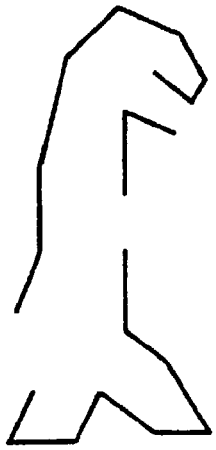
Figure 7D:
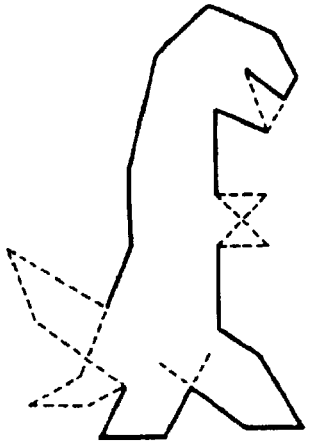
Figure 7E:
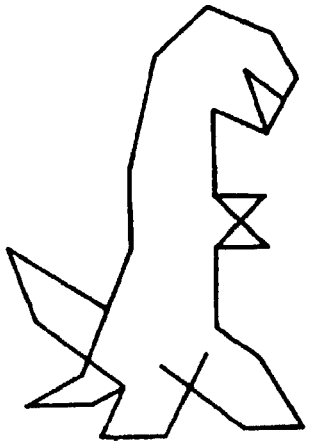
Figure 8A:
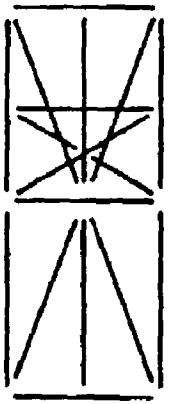
Figure 8B:
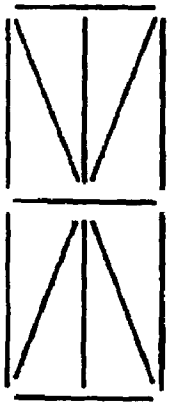
Figure 8C:
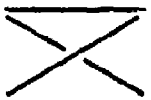
Figure 8D:
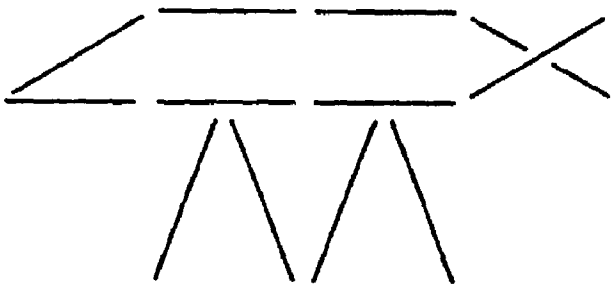
Figure 8E:
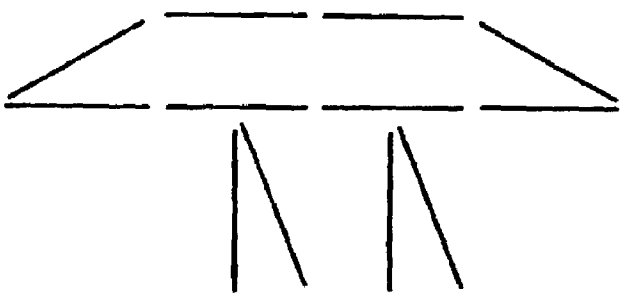
Figures 19A, 19B, 19C:
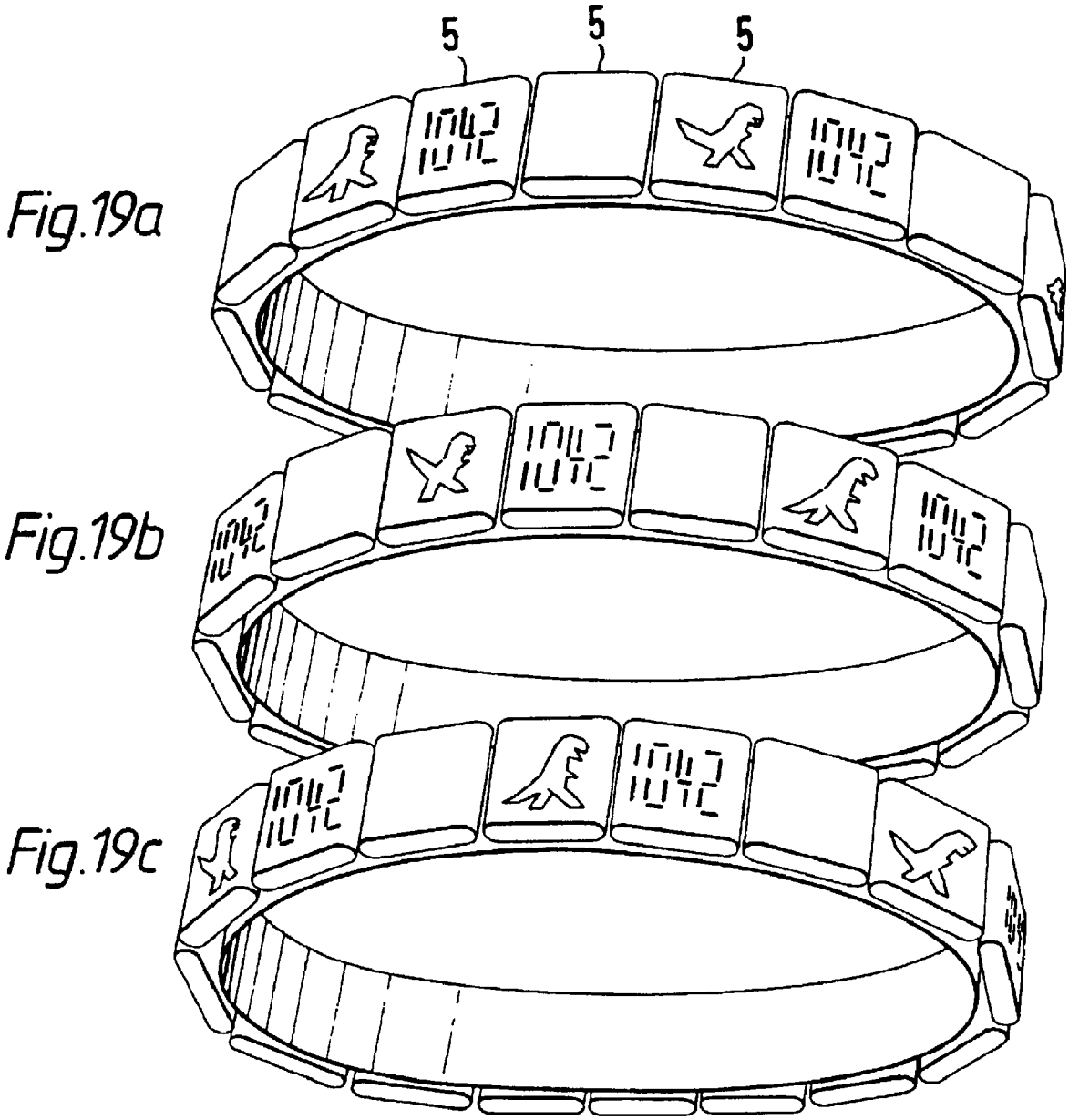

FIG. 19 shows a ninth embodiment of the present invention having a plurality of display units 5 similar to those of the first embodiment. Each display unit 5 has two overlapping lattices of liquid crystal segments. One lattice comprises four, seven-segment numerical display elements as in the first embodiment and the other lattice comprises a dinosaur lattice of two possible configurations, as shown in FIG. 7*e*. The display units 5 display the time, the dinosaur in a first configuration and the dinosaur in the other configuration alternately to give the impression of movement. Thus, FIGS. 19*a, b* and *c* show the characters displayed on the bracelet at successive moments in time.

It would be possible to incorporate different colour lighting units with each display unit 5 so that one colour is associated with each type of character displayed. For example, a blue light could be lit when the time is displayed, a red light when the dinosaur is displayed in the first configuration and an orange light with the dinosaur in the other configuration. Thus light patterns could be produced which move along the bracelet with time.

Various modifications may be made to the described embodiments and it is intended to include all such variations and modifications as fall within the scope of the accompanying claims.

The invention claimed is:

1. A bracelet having:

at least one electronic display unit constructed and arranged to display information in a sequence extending along substantially a full length of the bracelet; and a control device constructed and arranged to control said at least one display unit so that the information displayed appears to move along the length of the bracelet with time;

the bracelet being a wrist bracelet constructed and arranged to be worn around the wrist of a user, and the said at least one display unit having a plurality of segments such as to be selectively energizable by the control device to display information including at least one item selected from the group consisting of shapes and figures which are other than numeric arrangements and other than alphabetical arrangements, the control device and the segments being constructed and arranged to display at least one item which is representative of an entity which has, as a characteristic thereof, movement from one location to another.

2. A bracelet according to claim 1, wherein the segments are selectively energizable to display additional characters selected from the group consisting of numerical and alphabetical characters, as well as said items which are other than numeric and alphabetical arrangements.

3. A bracelet according to claim 1, wherein the at least one display unit has a dot-matrix display having cells arranged in a rectangular matrix.

4. A bracelet according to claim 1, wherein the at least one display unit has a plurality of display elements formed from independently controllable liquid crystal segments.

5. A bracelet according to claim 1, wherein the at least one display unit comprises a plurality of display units.

6. A bracelet according to claim 5, wherein the display units are arranged in close proximity to each other and are arranged in groups of at least three adjacent display units.

7. A bracelet according to claim 6, wherein each of the display units can be independently controlled.

8. A bracelet according to claim 7, wherein said control device is constructed and arranged to switch each of the display units in a group on and off intermittently and for a short period of time and to switch on and off adjacent units in a group successively along the length of the bracelet so that the information displayed appears to move along the length of the bracelet with time.

9. A bracelet according to claim 1, wherein the control device is constructed and arranged to display a message of a length greater than the length of the bracelet.

10. A bracelet according to claim 1, wherein the control device comprises an integrated circuit.

11. A bracelet according to claim 1, further comprising a memory constructed and arranged to store information including said items selected from the group consisting of shapes and figures which are other than numeric arrangements and other than alphabetical arrangements.

12. A bracelet according to claim 1, wherein the bracelet includes a receiver for receiving messages transmitted in the form of electromagnetic radiation to be displayed on said at least one display unit.

13. A bracelet according to claim 12, in which the bracelet is a pager.

14. A bracelet according to claim 1, including a memory and a programming device allowing the control device to be programmed by the user by downloading messages from a computer apparatus into the memory of the bracelet.

15. A bracelet according to claim 14, wherein the control device comprises an integrated circuit.

16. A bracelet according to claim 1, wherein said control device and the said segments are arranged to display characters which move.

17. A bracelet according to claim 1, wherein said control device and said segments are arranged to display animals which move.

18. A bracelet according to claim 1, wherein a first of the segments is a starting display segment and a second of the segments is an ending display segment, the item being displayed by virtue of movement of one of an individual shape and figure from segment to segment along the length of the bracelet, the shape or figure first appearing within the starting display segment and disappearing following display in the ending display segment.

19. A bracelet having:

at least one electronic display unit constructed and arranged to display information in a sequence extending along substantially a full length of the bracelet; and a control device constructed and arranged to control said at least one display unit so that the information displayed appears to move along the length of the bracelet with time;

the at least one display unit having a plurality of segments such as to be selectively energizable by the control device to display information including at least one item selected from the group consisting of shapes and figures which are other than numeric arrangements and other than alphabetical arrangements.

20. A bracelet according to claim 19, wherein the control device and the segments are arranged to display at least one item which is representative of an entity which has as a characteristic thereof movement from one location to another.

21. A bracelet according to claim 19, wherein the segments are selectively energizable to display additional characters selected from the group consisting of numerical and alphabetical characters, as well as said items which are other than numeric and alphabetical arrangements.

22. A bracelet according to claim 19, wherein the bracelet is a wrist bracelet.

23. A bracelet according to claim 19, wherein the at least one display unit has a dot-matrix display having cells arranged in a rectangular matrix.

24. A bracelet according to claim 19, wherein the at least one display unit has a plurality of display elements formed from independently controllable liquid crystal segments.

25. A bracelet according to claim 19, wherein the at least one display unit comprises a plurality of display units.

26. A bracelet according to claim 25, wherein the display units are arranged in close proximity to each other and are arranged in groups of at least three adjacent display units.

27. A bracelet according to claim 26, wherein each of the display units can be independently controlled.

28. A bracelet according to claim 27, wherein said control device is constructed and arranged to switch each of the display units in a group on and off intermittently and for a short period of time and to switch on and off adjacent units in a group successively along the length of the bracelet so that the information displayed appears to move along the length of the bracelet with time.

29. A bracelet according to claim 19, wherein the control device is constructed and arranged to display a message of a length greater than the length of the bracelet.

30. A bracelet according to claim 19, wherein the control device comprises an integrated circuit.

31. A bracelet according to claim 19, further comprising a memory constructed and arranged to store information including said items selected from the group consisting of shapes and figures which are other than numeric arrangements and other than alphabetical arrangements.

32. A bracelet according to claim 19, wherein the bracelet includes a receiver for receiving messages transmitted in the form of electromagnetic radiation to be displayed on said at least one display unit.

33. A bracelet according to claim 32, in which the bracelet is a pager.

34. A bracelet according to claim 19, including a memory and a programming device allowing the control device to be programmed by the user by downloading messages from a computer apparatus into the memory of the bracelet.

35. A bracelet according to claim 34, wherein the control device comprises an integrated circuit.

36. A bracelet according to claim 19, wherein said control device and the said segments are arranged to display characters which move.

37. A bracelet according to claim 19, wherein said control device and said segments are arranged to display animals which move.

38. A bracelet according to claim 19, wherein a first of the segments is a starting display segment and a second of the segments is an ending display segment, the item being displayed by virtue of movement of one of an individual shape and figure from segment to segment along the length of the bracelet, the shape or figure first appearing within the starting display segment and disappearing following display in the ending display segment.

39. A bracelet having:

at least one electronic display unit constructed and arranged to display information in a sequence extending along substantially a full length of the bracelet; and a control device constructed and arranged to control said at least one display unit so that the information displayed appears to move along the length of the bracelet with time;

the bracelet being a wrist bracelet constructed and arranged to be worn around the wrist of a user, and the said at least one display unit having a plurality of segments such as to be selectively energizable by the control device to display information including at least one item selected from the group consisting of shapes and figures which are other than numeric arrangements and other than alphabetical arrangements, the control device and the segments being constructed and arranged to sequentially display at least first and second configurations of a selected figure or shape of said shapes and figures, the first and second configurations being different in at least one respect to convey the appearance of characteristic movement of the selected figure or shape from one of said segments to another of said segments.

40. A bracelet having:

at least one electronic display unit constructed and arranged to display information in a sequence extending along substantially a full length of the bracelet; and a control device constructed and arranged to control said at least one display unit so that the information displayed appears to move along the length of the bracelet with time;

the bracelet being a wrist bracelet constructed and arranged to be worn around the wrist of a user, and the said at least one display unit having a plurality of segments such as to be selectively energizable by the control device to display information including at least one item selected from the group consisting of a shape and a figure which are representative of an entity that moves with time, the control device and the segments being constructed and arranged to sequentially display said entity from one of said segments to another of said segments to thereby convey the appearance of characteristic movement of the entity.

* * * * *